US005960806A

United States Patent [19]

Steiner

[11] Patent Number: 5,960,806

[45] **Date of Patent: *Oct. 5, 1999**

[54] PARASOL

[76] Inventor: Walter Steiner, Säntisstrasse 52 , CH-8311, Brütten, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/789,763

[22] Filed: Jan. 28, 1997

[30] Foreign Application Priority Data

Feb. 14, 1996 [CH] Switzerland ..... 00403/96

[51] Int. Cl.[6] ..... A45B 19/00

[52] U.S. Cl. ..... 135/20.1; 135/20.3; 135/21; 135/98

[58] Field of Search ..... 135/19, 20.1, 20.3, 135/21, 90, 98, 99, 15.1, 16, 88.03, 88.04

[56] References Cited

U.S. PATENT DOCUMENTS

| | | | |
|---|---|---|---|
| 288,703 | 11/1883 | Foster | 135/21 |
| 451,570 | 5/1891 | Painter | 135/21 |
| 504,900 | 9/1893 | Barnes . | |
| 508,418 | 11/1893 | Heaney | 135/21 X |
| 3,765,434 | 10/1973 | Riggs | 135/20.1 |
| 4,586,525 | 5/1986 | Glatz . | |
| 4,606,366 | 8/1986 | Collet . | |
| 5,116,258 | 5/1992 | Vennik | 135/20.3 |
| 5,551,465 | 9/1996 | Steiner . | |

FOREIGN PATENT DOCUMENTS

| | | | |
|---|---|---|---|
| 784815 | 7/1935 | France . | |
| 0948421 | 8/1949 | France | 135/20.1 |
| 3339163 | 3/1985 | Germany . | |
| 9306925 | 7/1993 | Germany . | |

*Primary Examiner*—Carl D. Friedman
*Assistant Examiner*—Kevin D. Wilkens
*Attorney, Agent, or Firm*—Ladas & Parry

[57] ABSTRACT

In the case of the parasol or sunshade the bearing forces for holding the awning (1) are transferred laterally by means of an awning bar (3') constructed as a supporting arm, so that the said forces are transferred by means of its associated spreader bar (4') laterally to the central shaft of its spreading open device (5) and from the latter to the other awning bars (4). For this purpose, adjacent to the edge of the awning (1), the awning bar (3') is pivotably retained on a joint (10), which is provided on a holding device (9) displaceable on the parasol post or pole (6). The awning (1) is opened with the aid of a rope (12), which passes from a fixing point (13) below the holding device (9) to a spreading open device (5) located on the parasol top (2). By an upward sliding of the holding device (9) and simultaneous swinging out of the awning bar (3') away from the post (6), a tensile stress occurs on the rope (12) and as a result the awning (1) is opened. The inclination of the awning (1) can be simply and reliably adjusted by modifying the inclination of the supporting arm (7).

2 Claims, 7 Drawing Sheets

PARASOL

BACKGROUND OF THE INVENTION

The invention relates to a sunshade or parasol having at least one awning carried by awning bars and spreader bars and openable by a lockable spreading open device and which in the vicinity of the outer end of one of the awning bars is fixed in, as desired, pivotable and vertically adjustable manner by a joint to a holding device positioned laterally outside the awning, the holding device being displaceable by means of an upright fixable guide.

A known parasol of this type according to U.S. Pat. No. 504,909 requires no aids for the operation of its spreading open device, because it is only intended for small, easily manually openable constructions.

It is known from U.S. Pat. No. 4,586,525 to operate the spreading open device of an awning by a tension rope guided in the manner of a pulley block. Through the suspension of the awning at the end of a cantilever arm, it is disadvantageous that the still considerable tensile force on the tension rope must be applied centrally outside the awning, so that the advantage of the free arm suspension is not fully utilized and e.g. a table located there must be moved aside beforehand. It is also disadvantageous that the forces for holding the awning are also concentrated in the inclined position in the vicinity of the parasol cap or top.

FR-A-784 815 discloses extending upwards out of the parasol top a tension rope for operating a spreading open device. As the tensile force must consequently be applied in the upwards direction above the awning, this is once again only suitable for relatively small parasols.

It is finally known from EP-B-91 433 to guide the tension rope of a spreading open device by means of reversing points up to the laterally positioned parasol pole or post and to fix it there. Thus, on laterally extending the awning a tensile stress occurs on the tension rope through which the spreading open device is actuated for opening the awning. The linkage construction used for the lateral extension and opening of the awning have a complicated construction and the actuation is correspondingly complicated. It is also not possible to adjust such parasols in an inclined position.

SUMMARY OF THE INVENTION

The problem of the invention is to provide a parasol which can be adjusted with respect to the inclination of its awning in which with a simple construction even large parasols and sunshades can easily be opened from a position at the edge of the awning and which allows a reliable holding of the awning in different positions.

According to the invention this problem is solved in that the spreading open device is operable by a tension rope, which is guided therefrom by means of reversing points to a fixing point located below the lowest adjustment position of the joint, so that the awning can be opened by an upward movement of the joint and the swinging out of the awning bar.

DESCRIPTION OF THE DRAWINGS

Advantageous embodiments of the invention are described in greater detail hereinafter relative to the drawings, wherein show.

DETAILED DESCRIPTION OF EMBODIMENTS

Figure 1:
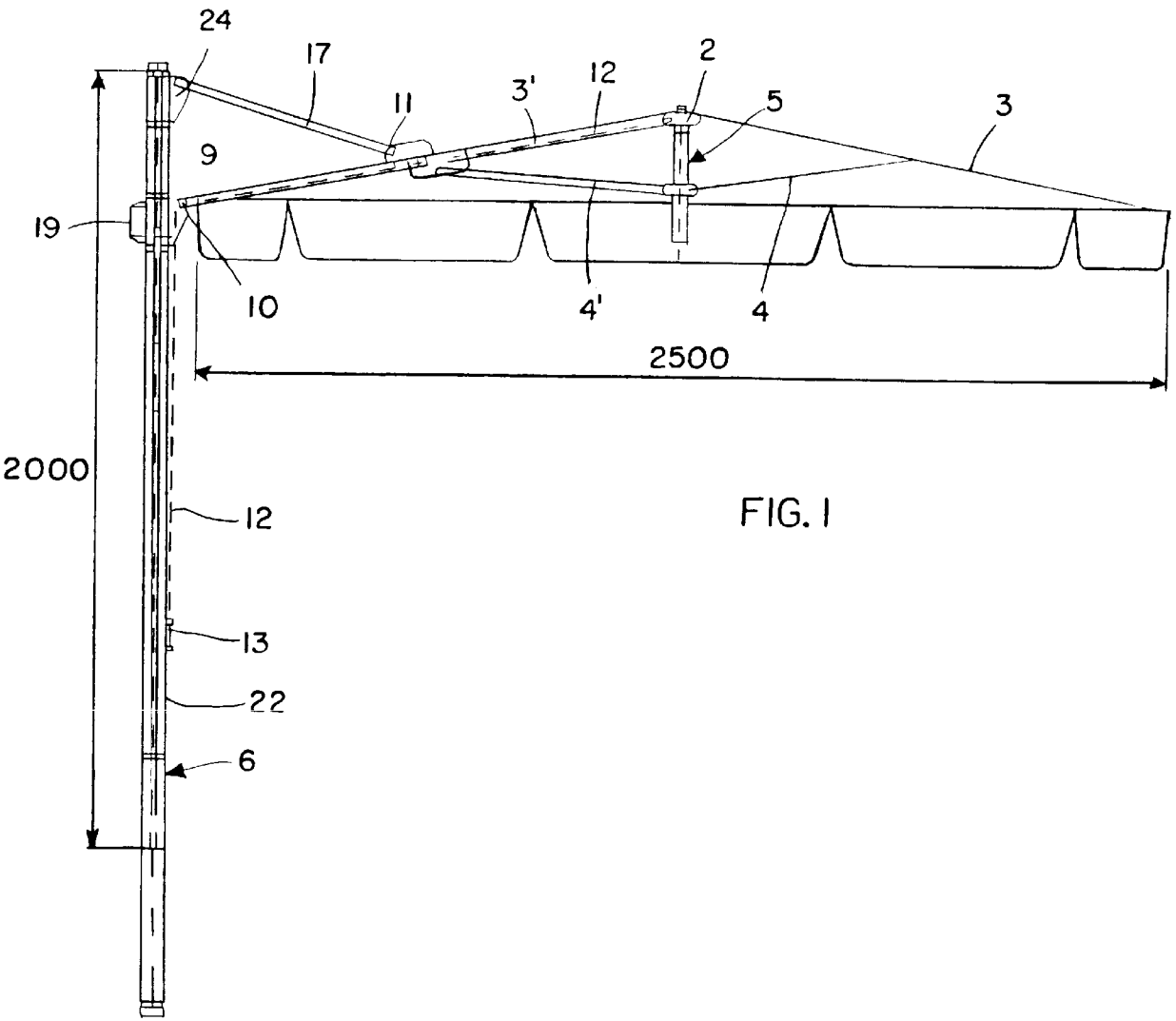
FIG. 1 A first embodiment of a parasol according to the invention with an awning bar constructed as a supporting arm.
Figure 1A:
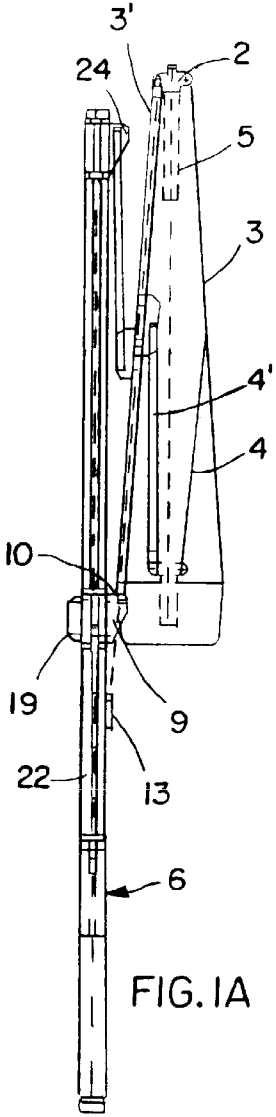
FIG. 1A The parasol according to FIG. 1 with the awning closed.
Figure 4:
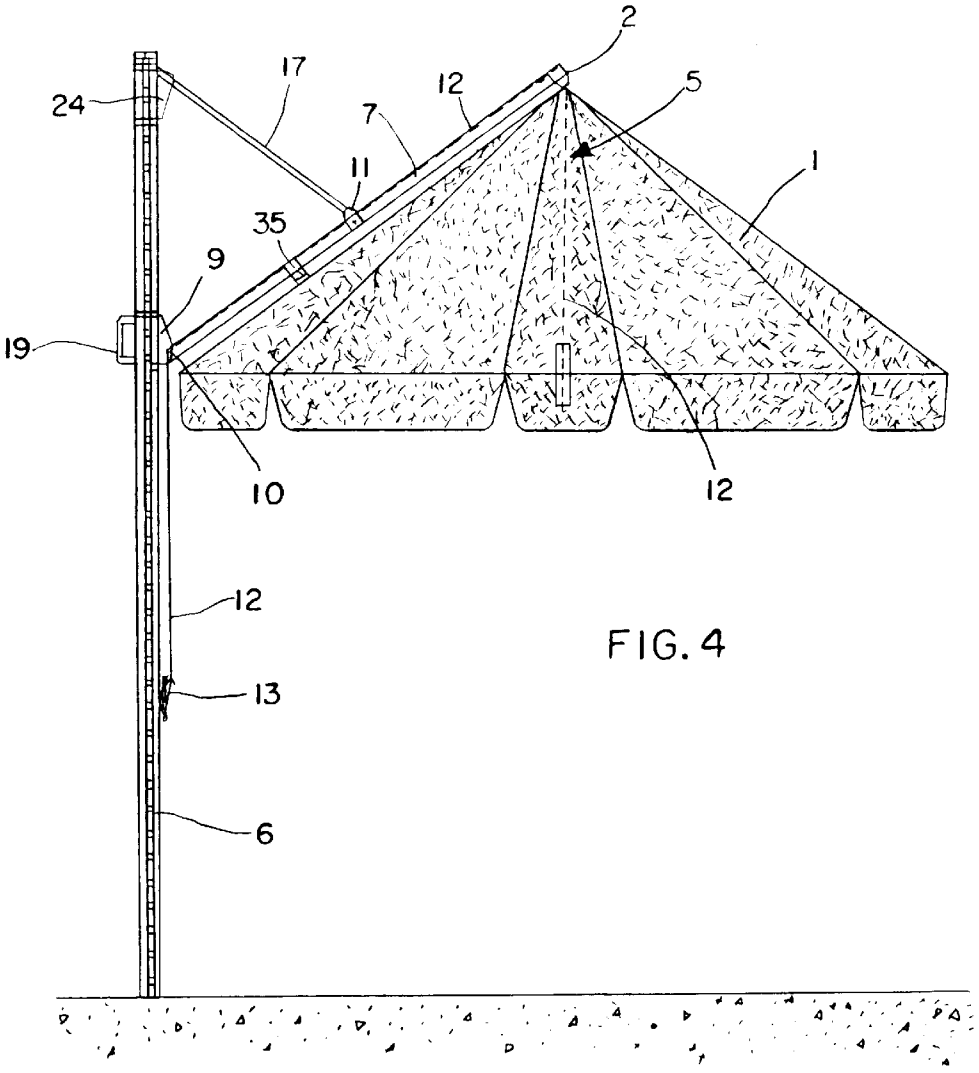
FIG. 4 The parasol of FIG. 3 in an intermediate opening position.
Figure 3:
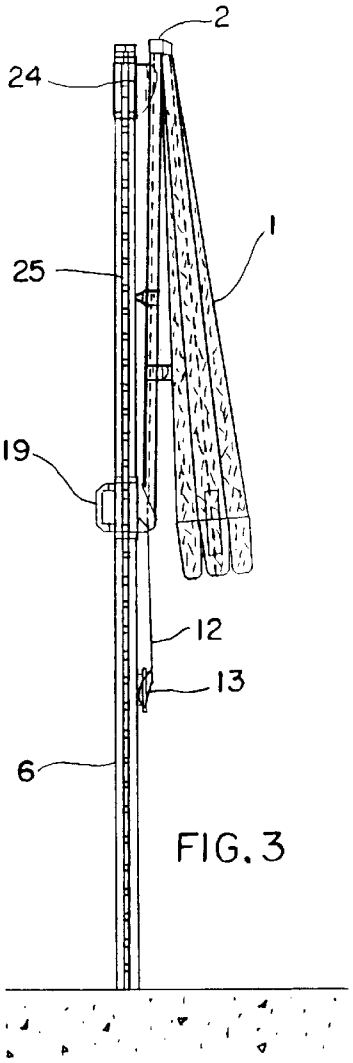
FIG. 3 A parasol corresponding to the embodiment of FIG. 2 in the folded up state, but with a one-piece parasol post.

The parasol or sunshade has an awning 1, which in per se known manner has a plurality of awning bars 3, 3' extending radially outwards from a parasol top or cap 2 and which are held in the spread open position by the spreader bars 4, 4' of a spreading open device 5.

In the embodiment according to FIG. 1 the forces for the free holding of the awning 1 are laterally absorbed by an awning bar 3' in the form of a supporting arm and are transferred by means of the associated spreader bar 4' to the shaft 8 of the spreading open device 5 and from the latter to the other spreader bars 4 and awning bars 3.

For this purpose the awning bar 3' and spreader bar 4' are made stronger and/or thicker than the remaining awning bars 3 and spreader bars 4 distributed circumferentially of the awning 1.

The fixing of the awning 1 takes place at the outer end of the awning bar 4' running below the awning 1 by means of a joint 10 provided on a holding device 9. For the position change of the holding device 9 necessary for opening the awning 1, said device is displaceably guided on a parasol post or pole 6 or on a not shown, vertically directed rail.

Figure 2:
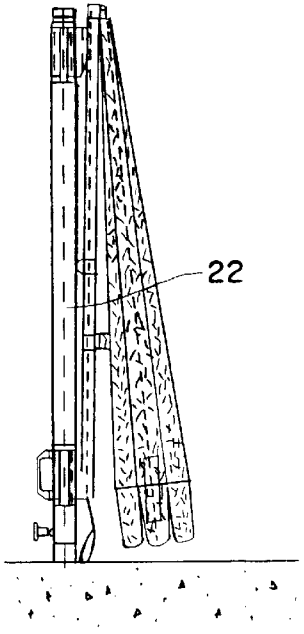
FIG. 2 A second embodiment of a parasol according to the invention in the folded up state and with telescoped parasol post.
Figure 6:
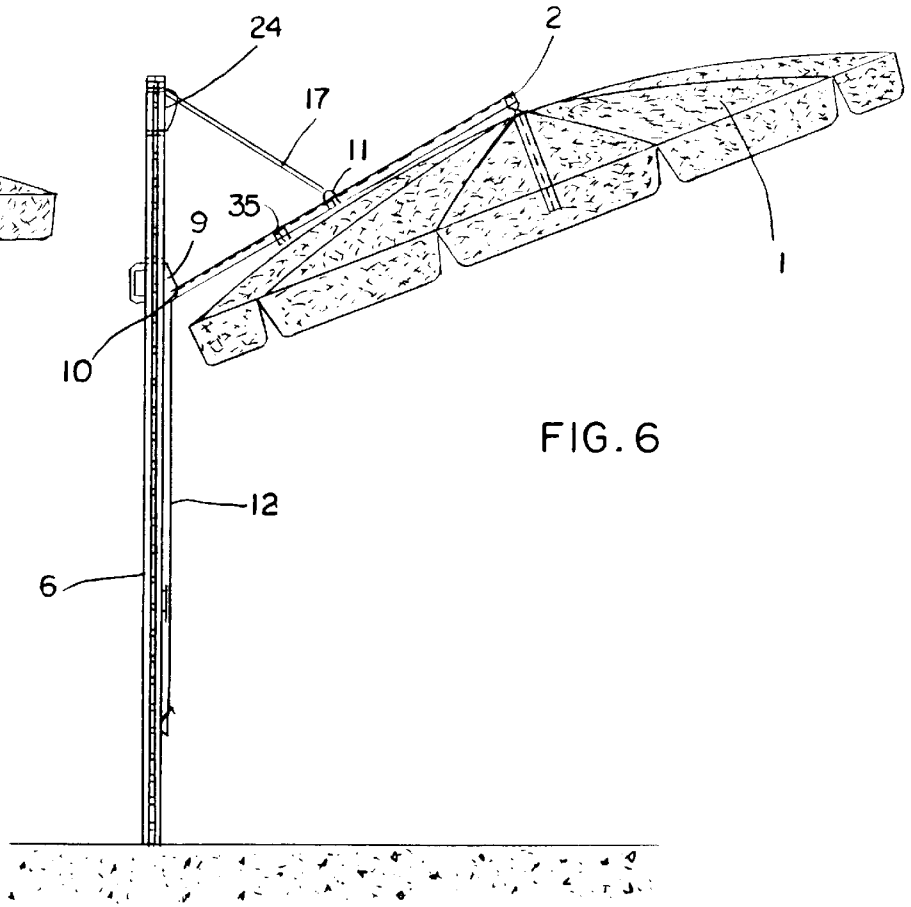
FIG. 6 The parasol of FIG. 5 in an inclined position.
Figure 5:
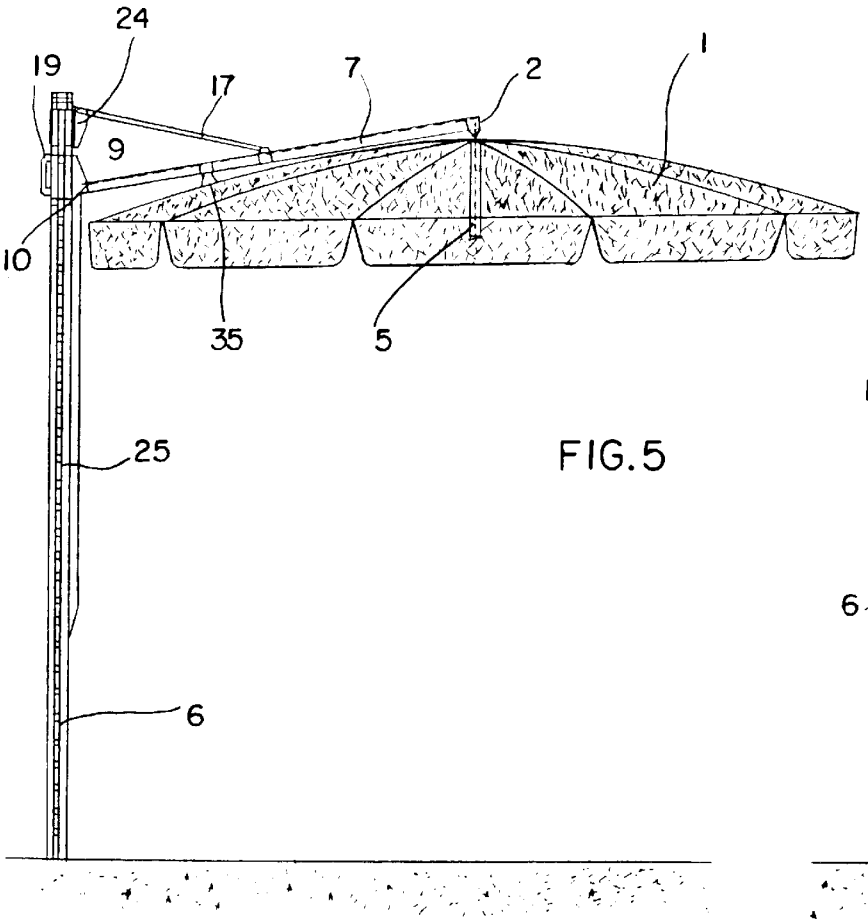
FIG. 5 The parasol of FIGS. 3 or 4 in the completely opened position.

When the parasol is not in use, the awning bar 3' serving as a supporting arm can consequently be pivoted upwards against the parasol post 6 after lowering the holding device 9, so that after folding up the awning 1 with the latter is obtained a compact structure similar to FIG. 2. It can be enveloped by a not shown parasol envelope or sleeve.

For a holding means which can undergo greater loading and also suitable for large parasols, as well as for the simple actuation of the awning 1, the latter is held or retained at two points, in that, spaced from the joint 10, a holding device 17 acts by means of a second joint 11 on the awning 1. Preferably said holding device 17 extends from above, so that in place of a support or strut 17, a holding rope could also be provided.

Figure 10:
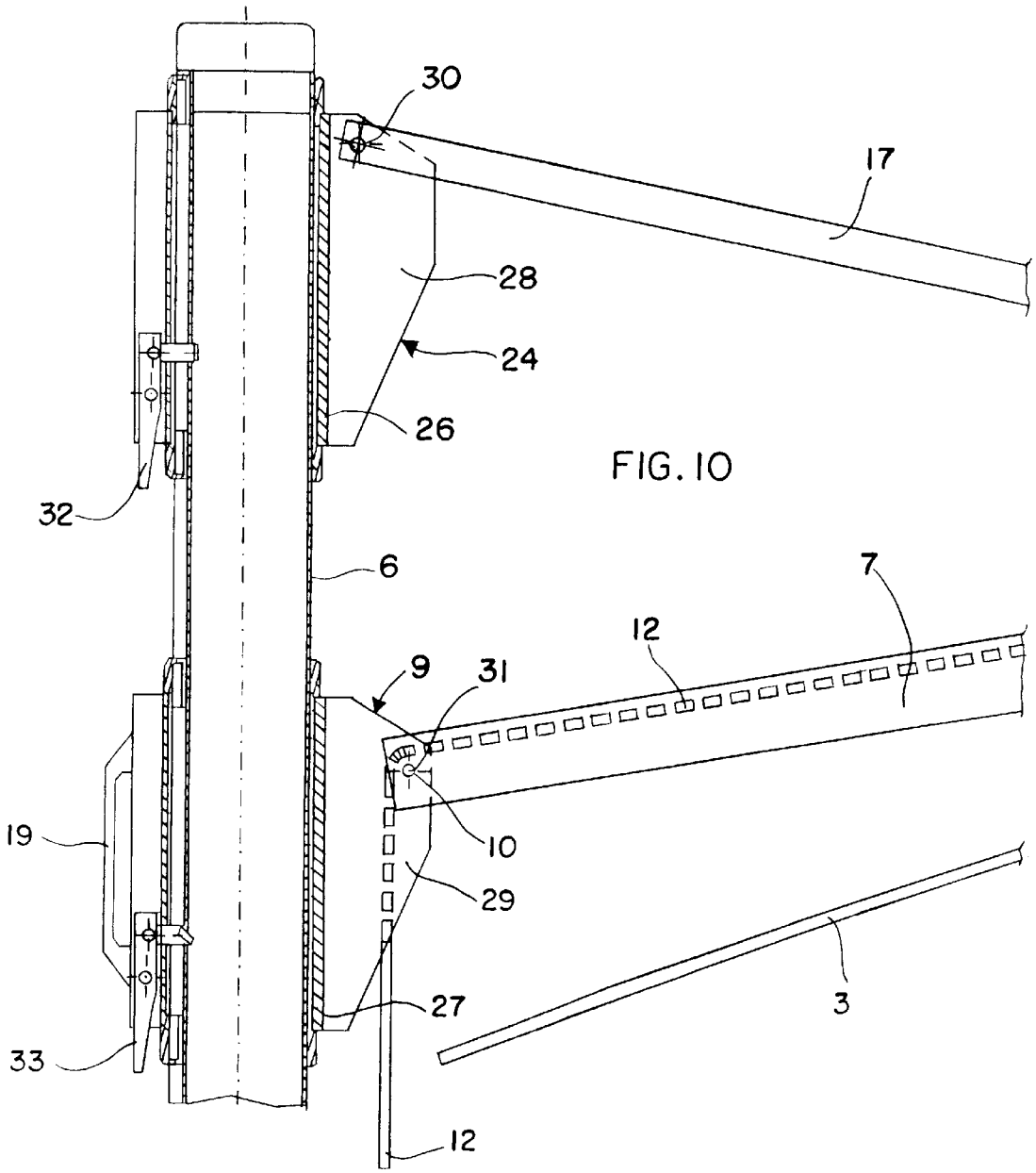
FIG. 10 A larger-scale representation of an area of FIG. 8, corresponding to a cross-section along line X—X of FIG. 11.
Figure 11:
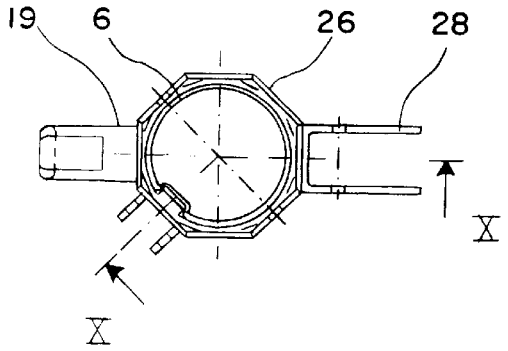
FIG. 11 A cross-section through the parasol post of FIG. 10.

As in the other embodiments of the invention described hereinafter, the awning 1 is opened with the aid of a rope 12 or by means of a band or chain. One end of the rope 12 is fixed below the displaceable holding device 9 to the parasol post 6 at point 13 and passes over a reversing point, e.g. in the form of a pulley, on the joint 10 of the holding device 9 to the awning bar 3' or to a supporting arm 7 according to FIGS. 2 to 10 and along the latter to the parasol top 2, as can best be seen in FIGS. 8 and 10. By means of a pulley 15 the rope 12 has a second reversing point on the parasol top 2 and then passes through the shaft 8 of the spreading open device 5, where it is fixed to the lower end of the shaft sleeve 16.

The upward movement of the holding device 9 e.g. takes place manually on the handle 19 or by means of a per se known mechanical aid, e.g. by a not shown crank drive. This leads to an increase in the spacing between the rope fixing point 13 and the holding device 9 or spreading open device 5, so that a tensile force occurs on the rope 12 through which the shaft sleeve 16 of the spreading open device 5 is drawn against the shaft 8 in accordance with FIGS. 8 and 9 and the awning 1, starting from the position according to FIG. 2, can open via the position of FIG. 4 to the position according to FIG. 5. The completely opened position is secured by the engaging of a pawl 20 provided on the shaft 8 in a locking recess 21 of the shaft sleeve 16. By pressing in the pawl 20 can be moved out of the locking recess again for folding up the parasol.

If the upward movement of the holding device 9 is not adequate for drawing up the shaft sleeve 16 until engagement occurs, the engagement on the spreading open device 5 can be brought about by laterally pulling on the rope 12 in the area between the rope fixing point 13 and the holding device 9 and this only involves limited force expenditure.

The guidance path of the rope 12 from the fixing point 13 on the post 6 to the spreading open device 5 can be in differing form, because a tensile stress on the rope 12 due to the upward movement of the joint 10 is ensured with a different arrangement of the reversing points. For example, the rope 12 could inter alia also be guided along the holding strut 17. It could also pass directly to the spreading open device 5 by means of a reversing point on the upper holding device 28.

Thus, the parasol can be opened by a simple sliding movement on the handle 19, in that by the latter the awning 1 is raised on its edge or on the joint 10 in the direction of the opening movement of the awning bar 3' and simultaneously the tensile stress occurring on the rope 12 actuates the spreading open device 5.

When the awning 1 has been completely opened and has been secured by engagement in this position, it forms a stable unit, which by a further displacement of the holding device 9 can undergo a position change without the awning 1 closing or opening. This is readily apparent by a comparison of the inclined positions of the awning 1 shown in FIGS. 5 and 6.

For the displaceability and lockability of the awning 1 in different positions on the parasol post 6 or on an upper, tubular post part 22 corresponding to FIG. 2, the holding device 9 and preferably also the second holding device 24 of the strut 17 are constructed similar to a sleeve body 26, 27 guided on the posts 6, on which are located fixing tongues 28, 29 for receiving a journal 30, 31 for the pivotable retaining of the awning bar 3' or supporting arm 7 and holding strut 17. Locking takes place by means of a manually operable pawl 32, 33 and numerous locking holes 25 arranged in rows on the pole 6 and which can be seen in FIG. 7.

Thus, both the inclination of the awning 1 and its height position can be modified by the displaceable construction of the auxiliary strut holder 24.

The embodiment according to FIGS. 2 to 10 shows that the supporting arm 7 need not be constructed according to the embodiment of FIG. 1 as a reinforced and extended awning bar 3', but can also run alongside the same, in that it is firmly connected thereto by at least one tongue 35 so as to form a functional unit. A common, identical orientation between the supporting arm 7 and the awning bar 3 so as to provide a functional unit results from the fact that both are coupled to one another in the area between the parasol top 2 and the joint 10 at at least two connection points 35.

As the rope 12 guided along the supporting arm 7 must be reversed towards the shaft 8 in the vicinity of the top 2, it is advantageous to place one of the connection points between the supporting arm 7 and the awning bar 3 on the top 2 of the awning 1, so that the further load distribution can take place from the latter.

Figure 7:
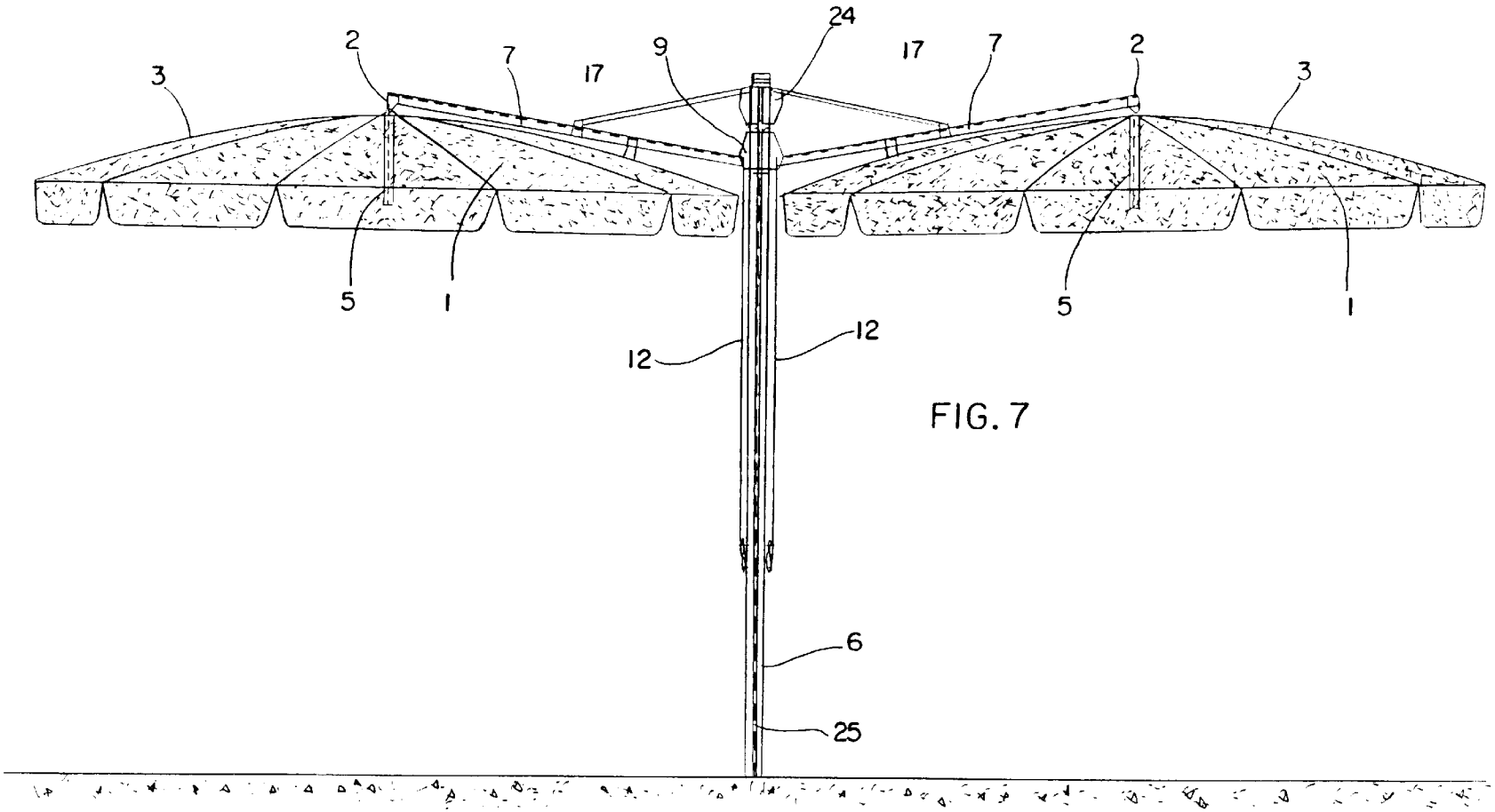
FIG. 7 A double or multiple construction of parasols according to FIG. 5 on a common parasol post.
Figure 9:
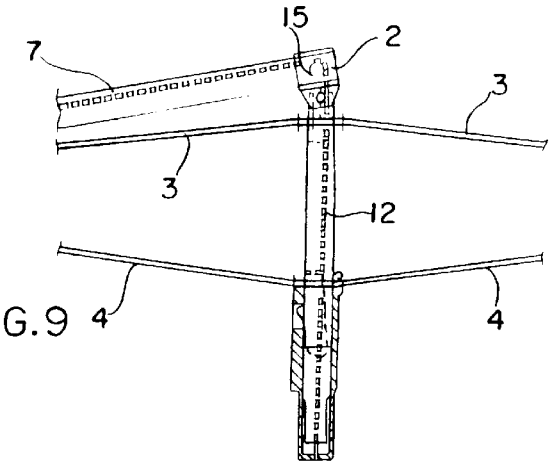
FIG. 9 A partial representation of the parasol of FIG. 5 in the vicinity of its spreading open device, in the engaged, complete open position.
Figure 8:
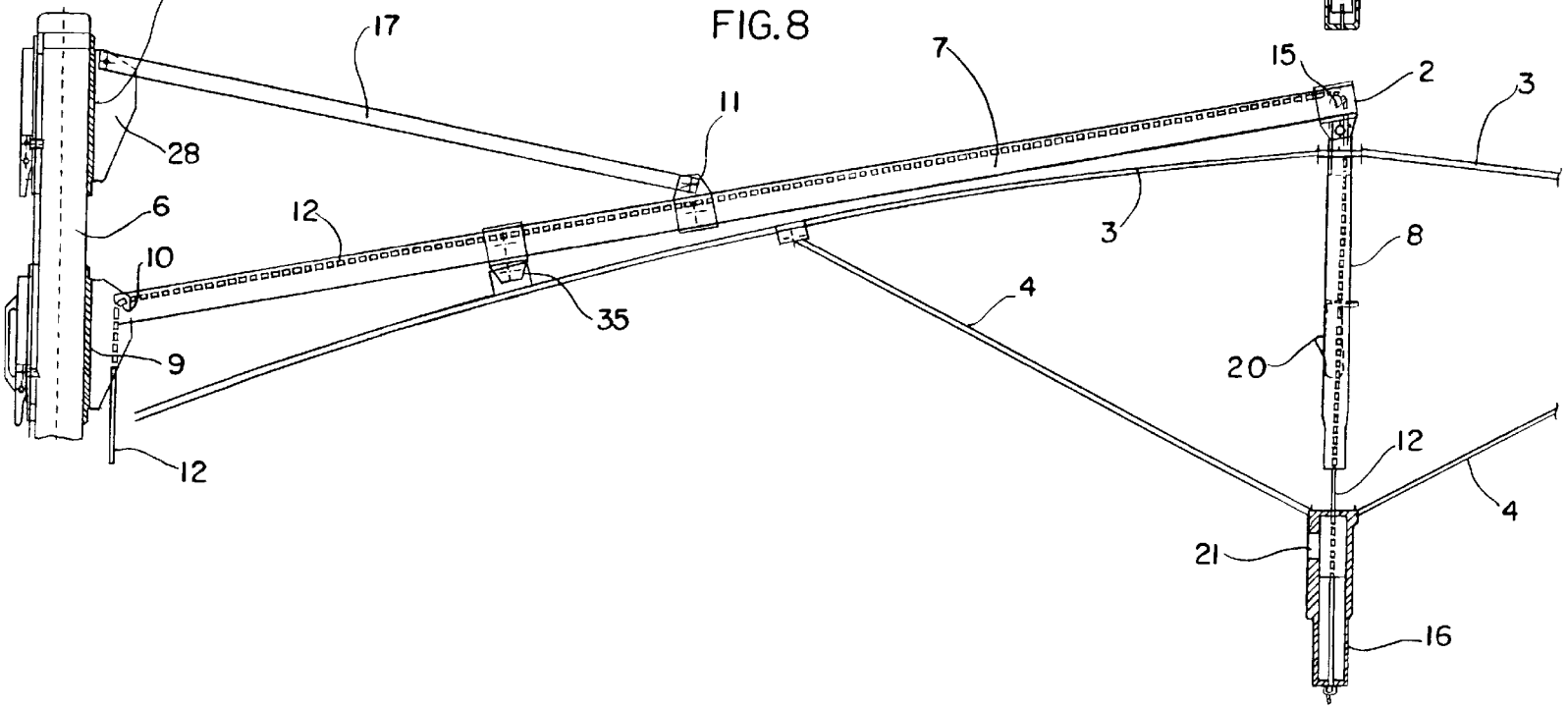
FIG. 8 A larger-scale cross-sectional representation of a parasol corresponding to an embodiment according to FIGS. 2 to 7 for illustrating the spreading open device.

The embodiment according to FIG. 7 shows that on the same parasol post 6 there can be held circumferentially several, e.g. four awnings 1. For the surface-covering arrangement of the awnings 1 in a circumferentially juxtaposed manner, the shape of the awnings, diverging from the conventional, approximately circular shape, can change in that the awning bars 3 can be given different lengths.

Figure 12:
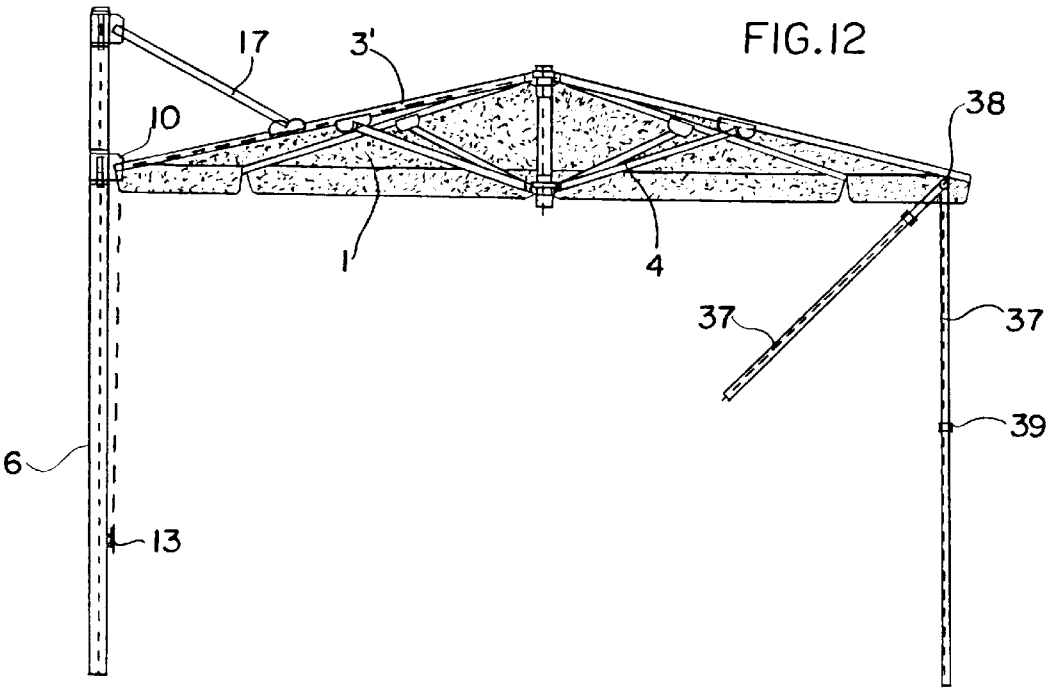
FIG. 12 An embodiment of the parasol according to the invention with an additional base support.

In the embodiment according to FIG. 12, at the outer end of at least two awning bars 3 facing the supporting arm 7 is fixed a length-variable base or ground support 37, so that the awning 1 can be supported on the side opposite to the supporting arm 7. If necessary, e.g. if wind forces occur, the base support 37 can be folded out downwards by means of a joint 38 and can be telescopically extended, so as to be hung on not shown base or ground anchors and can be fixed to the support guide 39 by tightening a lock nut.

Figure 13:
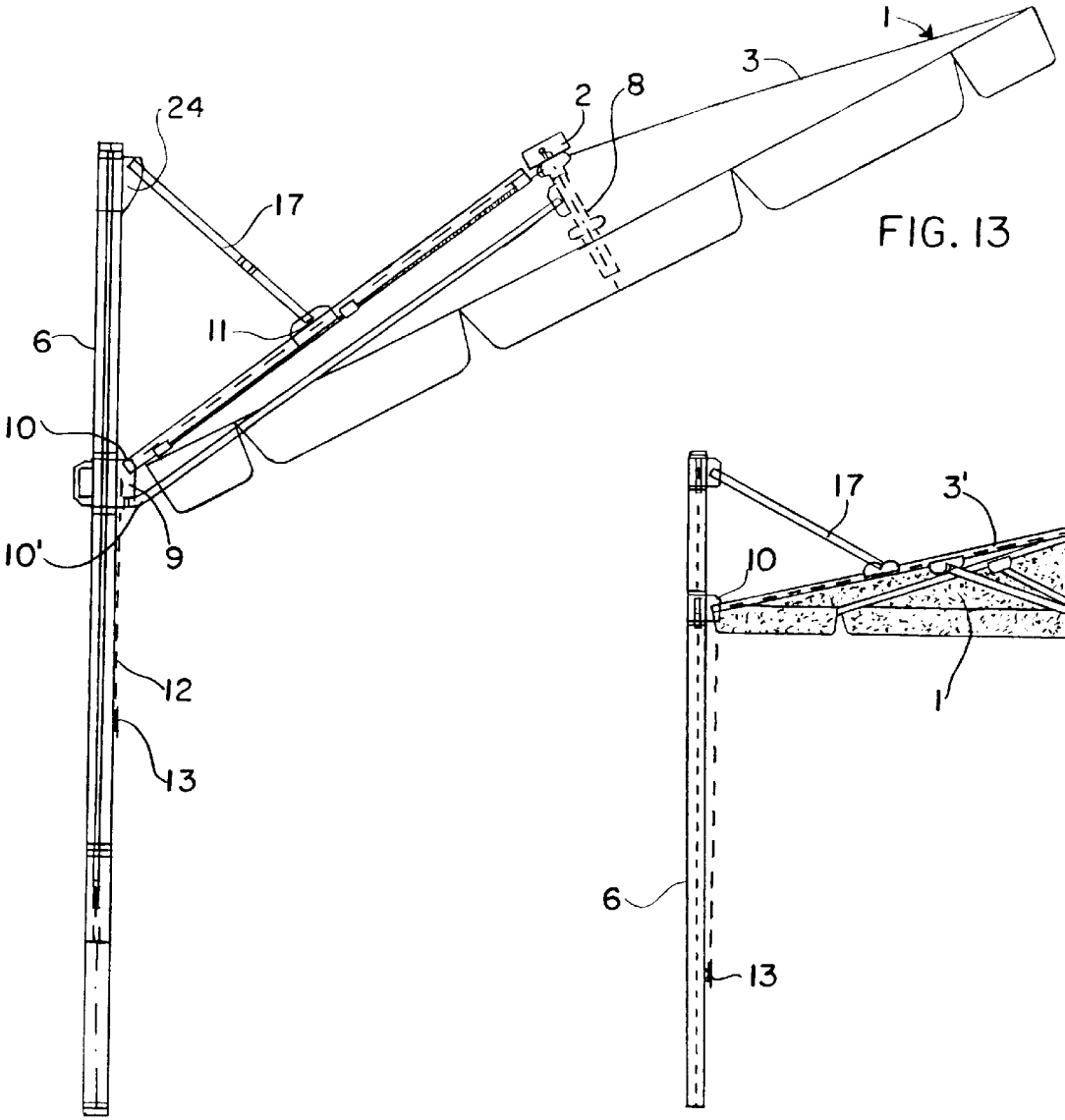
FIG. 13 Another embodiment of a parasol according to the invention in the inclined position.

In the embodiment according to FIG. 13 the awning 1 is held by two supporting arms 7, 7' forming a parallelogram, in that their ends are articulated in spaced manner on the one hand to the holding device 9 and on the other directly or indirectly to the shaft 8 of the spreading open device 5. As the unreinforced awning bar 3 running between the supporting arms 7 and 7' is firmly connected at several points to the upper supporting arm 7, the latter does not require its own articulation to the spreading open device shaft 8, because the awning bar 3 engaging thereon is articulated there and consequently also takes over the articulation of the upper supporting arm 7.

For embodiments in which the supporting arm is identical to a reinforced awning bar 3', the articulation of the auxiliary strut 17 can also take place through a small recess in the awning 1. In another construction all the awning bars 3, 3' are not covered by the awning 1, in that the latter has a profile for the lateral welt-fixing of individual, awning-forming surface elements, which in sector-like manner in each case fill the space between two awning bars 3, as is known per se from U.S. Pat. No. 5,551,465.

I claim:

1. A parasol comprising:

a. an awning supported on a plurality of awning bars which are, in turn, supported by a plurality of spreader bars;

b. a spreading device coupled to first ends of the plurality of awning bars and to the plurality of spreader bars, said spreading device being adjustable to place the awning in a range of awning positions between and including a closed position and a fully opened position;

c. a locking mechanism associated with the spreading device, the locking mechanism having a locked state in which the spreading device is secured in a position within said range of awning positions.

d. a guide member;

e. a supporting element pivotally connected at one end to the guide member and, pivotally connected at second end to the one of said plurality of awning bars;

f. a tension element attached at one end to the guide member and at an opposite end to the spreading device, and g a holding device slidably attached to the guide member, the holding device being pivotally attached to the one of said plurality of awning bars, the holding device causing the one of said plurality of awning bars to swing away from the guide member and the spreading device to spread the plurality of spreader bars and the plurality of awning bars to open the awning upon movement of the holding device along the guide member, wherein the awning is pivoted upon movement of the holding device along the guide member when the locking mechanism is in the locked state.

2. The parasol as claimed in claim 1, wherein the one of said plurality of awning bars is stronger than all others of said plurality of awning bars.

* * * * *